US009985376B2

(12) United States Patent
Zhang

(10) Patent No.: US 9,985,376 B2
(45) Date of Patent: May 29, 2018

(54) CONNECTION MEMBER AND CONNECTION ASSEMBLY

(71) Applicant: Tyco Electronics (Shanghai) Co. Ltd., Shanghai (CN)

(72) Inventor: Weidong Zhang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days. days.

(21) Appl. No.: 15/444,688

(22) Filed: Feb. 28, 2017

(65) Prior Publication Data

US 2017/0250488 A1 Aug. 31, 2017

(30) Foreign Application Priority Data

Feb. 29, 2016 (CN) ..... 2016 1 0111669

(51) Int. Cl.

| | |
|---|---|
| ***H01R 13/40*** | (2006.01) |
| ***H01R 13/426*** | (2006.01) |
| ***H01R 13/53*** | (2006.01) |
| ***H01R 43/16*** | (2006.01) |
| ***H01R 13/11*** | (2006.01) |

(52) U.S. Cl.

CPC ..... *H01R 13/426* (2013.01); *H01R 13/113* (2013.01); *H01R 13/53* (2013.01); *H01R 43/16* (2013.01)

(58) Field of Classification Search

CPC ..... H01R 13/113; H01R 13/53
USPC ..... 439/682, 660, 733.1, 637, 862
See application file for complete search history.

(56) References Cited

U.S. PATENT DOCUMENTS

| | | | | | |
|---|---|---|---|---|---|
| 4,934,965 | A * | 6/1990 | Buddrus | H01R 13/113 | 439/845 |
| 5,033,982 | A * | 7/1991 | Lucas | H01T 13/04 | 439/125 |
| 5,310,357 | A * | 5/1994 | Olson | H01R 12/716 | 439/346 |
| 5,474,479 | A * | 12/1995 | Bennett | H01R 13/187 | 439/843 |
| 5,886,501 | A * | 3/1999 | Marks | H01M 2/206 | 320/107 |
| 6,053,776 | A * | 4/2000 | Bricaud | G06K 7/0021 | 439/630 |
| 6,149,466 | A * | 11/2000 | Bricaud | G06K 7/0021 | 235/441 |

(Continued)

*Primary Examiner* — Abdullah Riyami
*Assistant Examiner* — Vladimir Imas
(74) *Attorney, Agent, or Firm* — Faegre Baker Daniels LLP

(57) ABSTRACT

The invention discloses a connection member and a connection assembly. The connection assembly includes a housing and the connection member. The connection member is inserted in an accommodation chamber of the housing. The connection member includes a support body, a current conduction bar, and a protruding contact portion. The support body is defined by a surface and end portions. The current conduction bar is connected to the end portions of the support body, and the current conduction bar is used to transmit a current. The protruding contact portion is disposed on the surface of the support body in a protruding manner, and is used to be urged against the housing with which the connection member engages. The connection member of the present invention is capable of connecting to the housing via the protruding contact portion.

20 Claims, 10 Drawing Sheets

(56) References Cited

U.S. PATENT DOCUMENTS 6,287,156 B1 * 9/2001 Swan ..... H01R 13/187 439/790
6,354,891 B1 * 3/2002 Schnell ..... G06K 7/0021 439/630
6,672,911 B2 * 1/2004 Zhao ..... H01R 11/22 439/271
6,692,316 B2 * 2/2004 Hsieh ..... H01R 13/187 439/224
7,442,082 B2 * 10/2008 Ma ..... H01R 13/65802 439/607.01
7,458,862 B2 * 12/2008 Zhao ..... H01M 2/206 439/840
7,601,019 B2 * 10/2009 Hsieh ..... H01R 13/426 439/345
7,651,338 B2 * 1/2010 Miyamoto ..... H01R 13/2442 439/66
7,717,744 B2 * 5/2010 Ma ..... H01R 12/7076 439/607.1
7,789,720 B2 * 9/2010 Zinn ..... H01R 13/113 439/370
7,931,105 B2 * 4/2011 Sato ..... B60K 1/04 180/2.1
7,955,129 B2 * 6/2011 Hu ..... H01R 12/57 439/607.01
8,100,724 B2 * 1/2012 Lin ..... H01R 12/716 439/218
8,128,441 B2 * 3/2012 Mukuno ..... H01R 13/055 439/845
8,419,486 B2 * 4/2013 Tyler ..... H01R 13/113 439/842
8,628,335 B1 * 1/2014 Zhao ..... H01M 2/206 439/33
8,668,531 B2 * 3/2014 Yamaguchi ..... H01R 13/187 439/843
8,727,810 B2 * 5/2014 Yoshida ..... H01R 4/028 439/630
8,827,754 B2 * 9/2014 Lee ..... H01R 13/187 439/843
8,827,755 B2 * 9/2014 Blakborn ..... H01R 13/113 439/845
8,961,215 B2 * 2/2015 Hasegawa ..... H01R 9/091 439/346
9,136,636 B2 * 9/2015 Zhang ..... H01R 13/516
9,312,643 B2 * 4/2016 Jeon ..... H01R 13/6587
9,337,466 B2 * 5/2016 Zhao ..... H01M 2/206
9,385,458 B2 * 7/2016 Jeon ..... H01R 13/6587
9,391,408 B2 * 7/2016 Katayanagi ..... H01R 13/6582
9,515,403 B2 * 12/2016 Hirakawa ..... H01R 4/184
9,553,380 B2 * 1/2017 Fang ..... H01R 12/714
2002/0187686 A1 * 12/2002 Zhao ..... H01R 13/187 439/843
2003/0060090 A1 * 3/2003 Allgood ..... H01R 11/289 439/845
2006/0270286 A1 * 11/2006 Zhao ..... H01M 2/206 439/840
2007/0232154 A1 * 10/2007 Zhao ..... H01M 2/206 439/759
2012/0315802 A1 * 12/2012 Blakborn ..... H01R 13/113 439/700
2013/0089996 A1 * 4/2013 Zhao ..... H01M 2/206 439/212

* cited by examiner

CONNECTION MEMBER AND CONNECTION ASSEMBLY

CROSS-REFERENCE TO RELATED APPLICATION

This patent application claims the benefit of Chinese Priority Patent Application No. 201610111669.7 filed on Feb. 29, 2016 in China, the whole disclosure of which is incorporated herein by reference.

TECHNICAL FIELD

The present invention relates generally to a connection structure for achieving an electrical connection, and particularly to a connection member and a connection assembly.

BACKGROUND

As the number of types of electronic devices increases, the number of types of connection members that need to achieve stable connection performance increases. A connection member can connect electronic devices, conducting wires, or connection terminals. One of the important reference indices of desirable performance of a connection member is stable electrical connection. In order to achieve a stable electrical connection, a connection member not only needs to be in proper contact to continuously transmit a required current, but also needs to have a relatively great current conduction capacity.

SUMMARY OF THE INVENTION

An objective of the present invention is to provide a connection member and a connection assembly with compact structure and good connection performance, so as to eliminate defects in the prior art.

In order to achieve the foregoing objective, the present invention is implemented by using the following technical solution.

The present invention provides a connection member, which can include a support body, where the support body is defined by a surface and has a support end portion. The connection member can also include a current conduction bar, where the current conduction bar is connected to the support end portion of the support body, and the current conduction bar is used to transmit a current. The connection member can further include a protruding contact portion, where the protruding contact portion is disposed on the surface of the support body in a protruding manner, and is used to be urged against a housing with which the connection member engages.

Preferably, the protruding contact portion extends along the length direction of the current conduction bar.

Preferably, the protruding contact portion abuts the current conduction bar along a length direction of the current conduction bar.

Preferably, the protruding contact portion has partially ellipsoidal surface.

Preferably, the protruding contact portion is of a stamped structure.

Preferably, two support end portions are provided; these two support end portions are spaced from each other along the length direction of the current conduction bar and disposed at a front end and a rear end of the support body; two ends of the current conduction bar are connected to the two support end portions respectively; and the protruding contact portion is disposed on a surface of at least one of the support end portions.

Preferably, each of the support end portions has an upper end portion and a lower end portion. The support body is provided with a chamber that runs through the support body along the length direction of the current conduction bars. The chamber is disposed between the upper end portion and the lower end portion. The protruding contact portion is disposed on an upper surface of the upper end portion and/or a lower surface of the lower end portion.

Preferably, the connection member further includes a reinforcing portion, two ends of the reinforcing portion are connected to the two support end portions respectively, and each end of the reinforcing portion is connected to the upper end portion and the lower end portion of the corresponding support end portion.

Preferably, the surface of the support body includes an upper surface and a lower surface, and the upper surface and the lower surface are both provided with the protruding contact portion.

Preferably, two groups of current conduction bars are provided, each group of current conduction bars includes at least one current conduction bar, and these two groups of current conduction bars are disposed back to back.

Preferably, the current conduction bars are spaced from each other.

Preferably, the current conduction bar arches in a direction opposite to the protruding direction of the protruding contact portion, to form a terminal contact portion. The terminal contact portion is used to come into electrical contact with a mating terminal.

Preferably, the current conduction bar includes an arching portion, and the arching portion arches along a protruding direction of the protruding contact portion.

Preferably, the connection member is an integrally stamped member.

Preferably, the connection member further includes mounting claws; the mounting claws are disposed at front and rear ends of the support body in a protruding manner; and the mounting claws are configured to be capable of bending to engage with the housing as a retainer, the housing engages with the connection member.

The present invention further provides a connection assembly, where the connection assembly includes a housing and the foregoing connection member, where the housing has an accommodation chamber, the connection member is inserted in the accommodation chamber, and the protruding contact portion is urged against the housing.

Preferably, the connection member further includes mounting claws, the mounting claws are disposed on the support body in a protruding manner, and the mounting claws engage with the housing as a retainer.

Preferably, the housing includes a mounting portion and a support plate; the support plate is disposed on the mounting portion and extends along a length direction of the mounting portion; and the accommodation chamber is opened on the mounting portion.

Preferably, the front end portion and the rear end portion of the mounting portion are provided with limiting slots. The mounting claws are accommodated in the limiting slots.

Preferably, the opening of the limiting slot is provided with limiting portions that protrude laterally, and the limiting portions are used to limit the mounting claw within the limiting slot.

Compared with the prior art, the connection member of the present invention is connected to the housing via the protruding contact portions, so that not only a contact area is increased, but also shaking of the connection member in the housing is avoided, thereby not only improving a large-current passing capacity, but also improving electrical connection stability. Compared with that current conduction bars not only need to transmit a current but also need to come into contact with a housing to achieve electrical connection, in the present invention, the protruding contact portions are only used to come into contact with the housing, so that the structures of the protruding contact portions and current conduction bars can be more easily realized, and performance is better.

Preferably, the protruding contact portions extend, so that more stable connection performance can be achieved. The protruding contact portions abut the current conduction bars in a one-to-one correspondence, so that the transmission distance can be reduced, and the transmission loss can be reduced. The protruding contact portions have a partially ellipsoidal surface, so that when the protruding contact portions are relatively large in number, stable contact can be maintained even in a relatively large tolerance range. The terminal contact portions of the current conduction bar arch toward the inside of the chamber of the support body, thereby facilitating to form a plug-in engagement with a mating male terminal and to form a desirable contact. Arching portions of the current conduction bars can come into contact with the housing when the current conduction bars 20 forms plug-in engagement with the mating male terminal, thereby increasing an electrical contact area and improving electricity conduction performance.

BRIEF DESCRIPTION OF DRAWINGS

The following description is set forth in connection with the attached drawing figures, which are not necessarily to scale, emphasis instead generally being placed upon illustrating the principles of the invention. In the drawing figures.

DETAILED DESCRIPTION OF EMBODIMENTS

Figure 1:
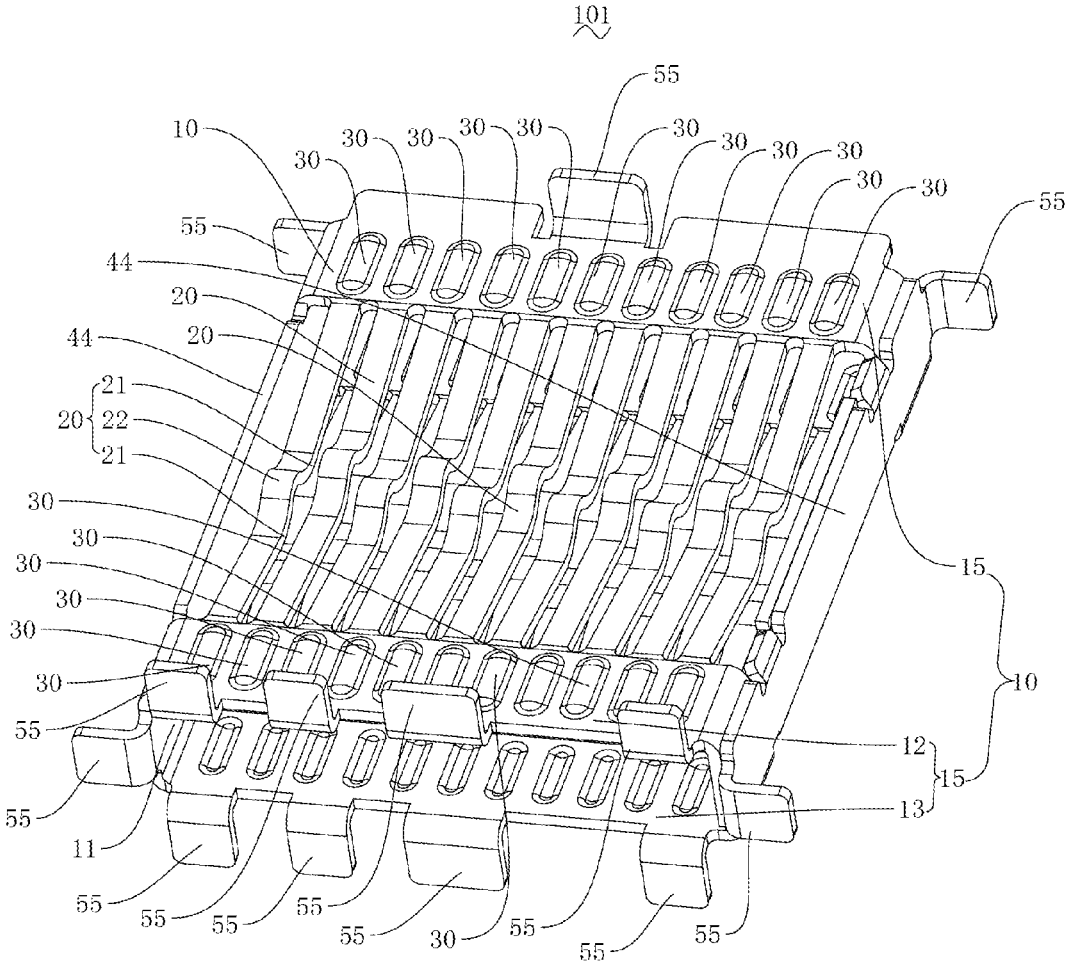
FIG. 1 is a schematic structural view of a connection member according to the present invention.
Figure 2:
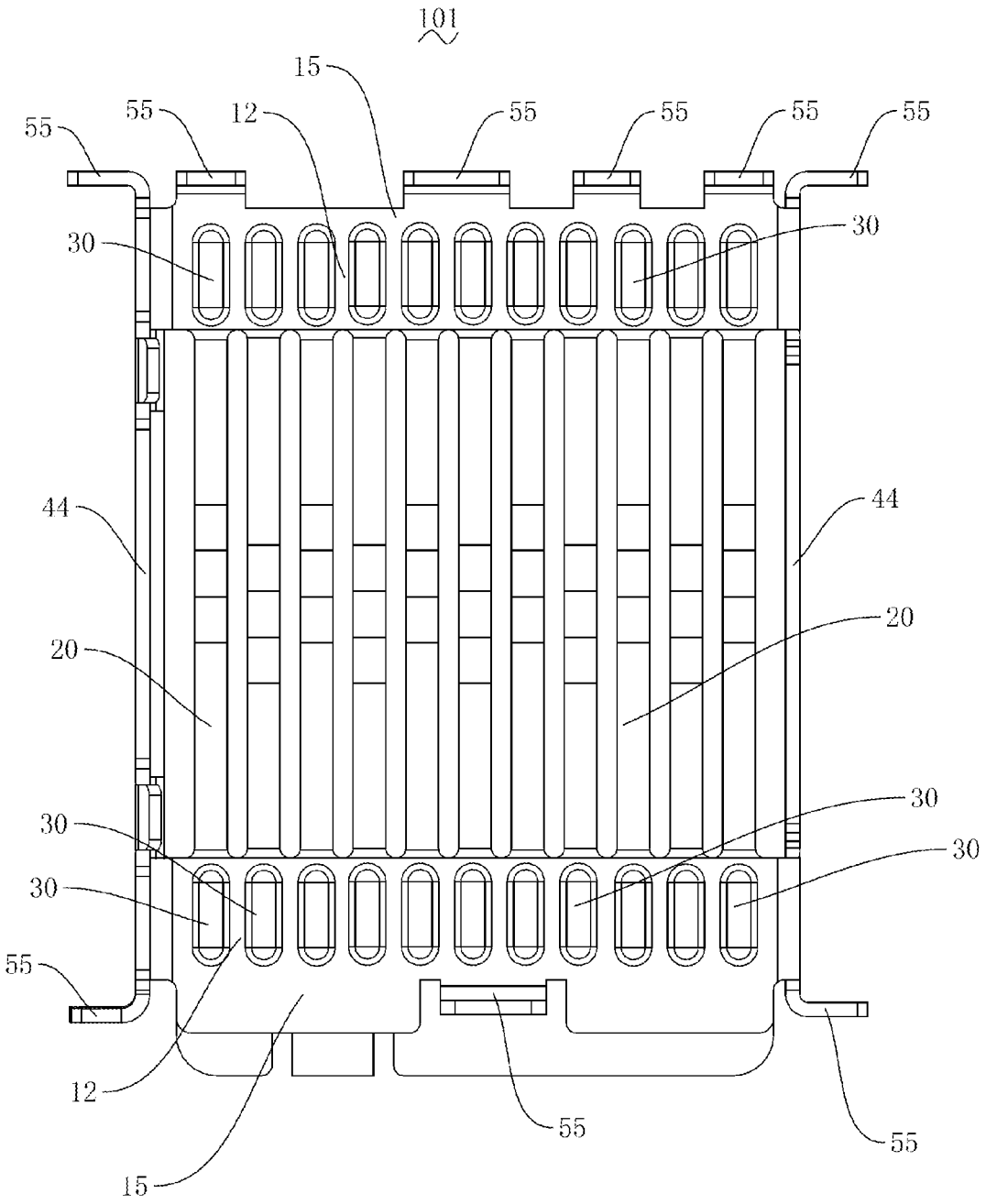
FIG. 2 is a top view of the connection member in FIG. 1.
Figure 3:
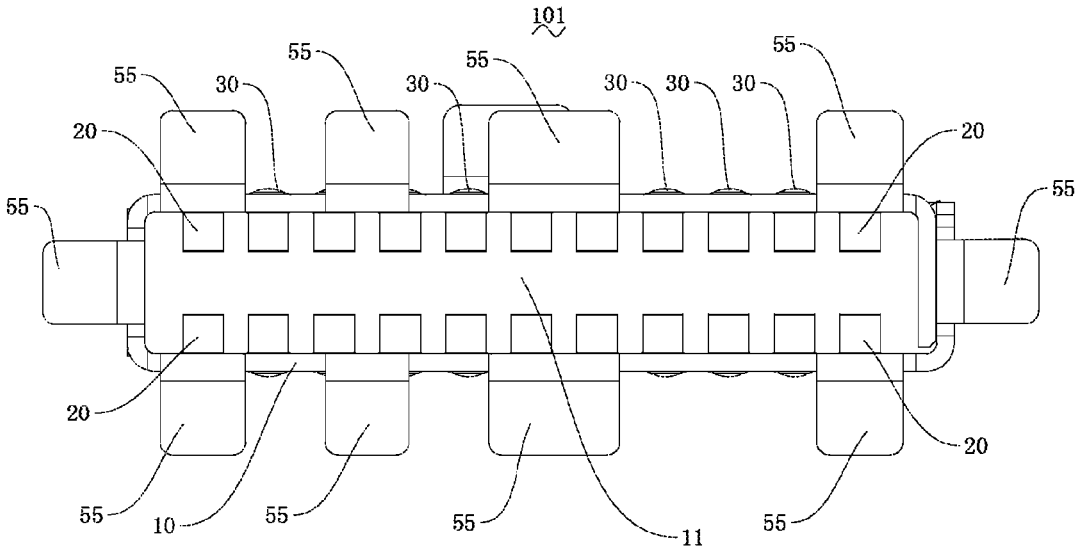
FIG. 3 is a front view of the connection member in FIG. 1.
Figure 4:
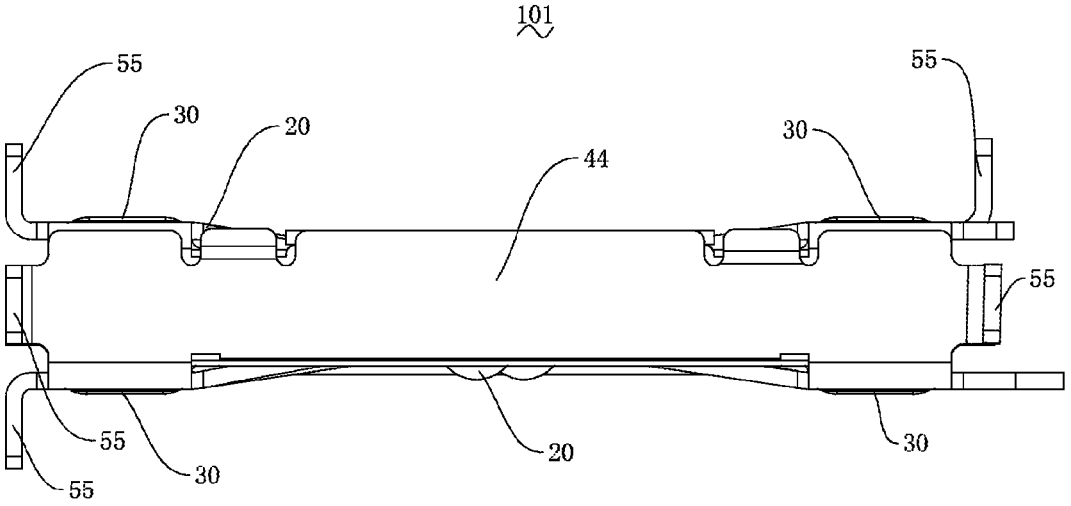
FIG. 4 is a right view of the connection member in FIG. 1.
Figure 5:
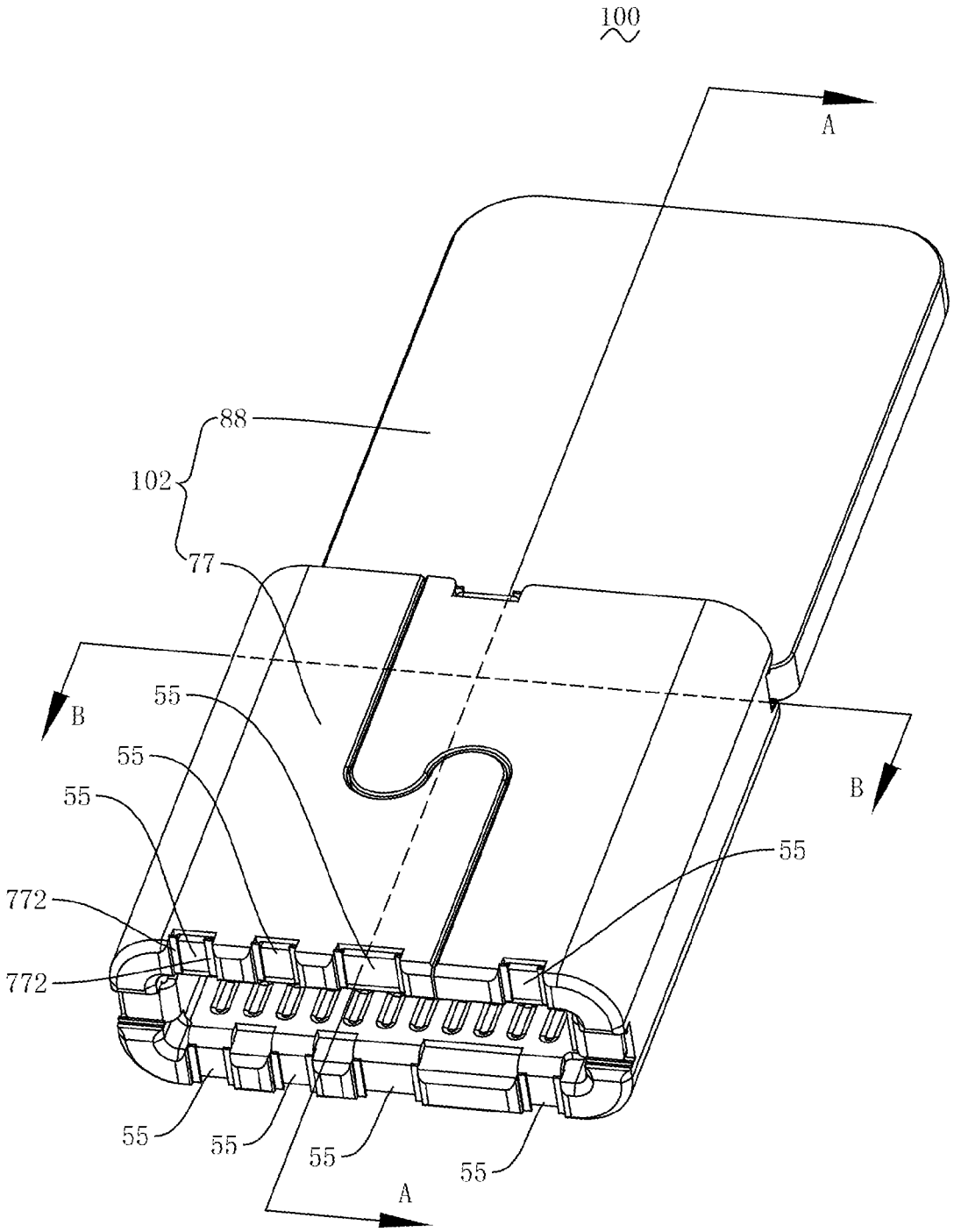
FIG. 5 is a schematic structural view of a connection assembly according to the present invention.
Figure 6:
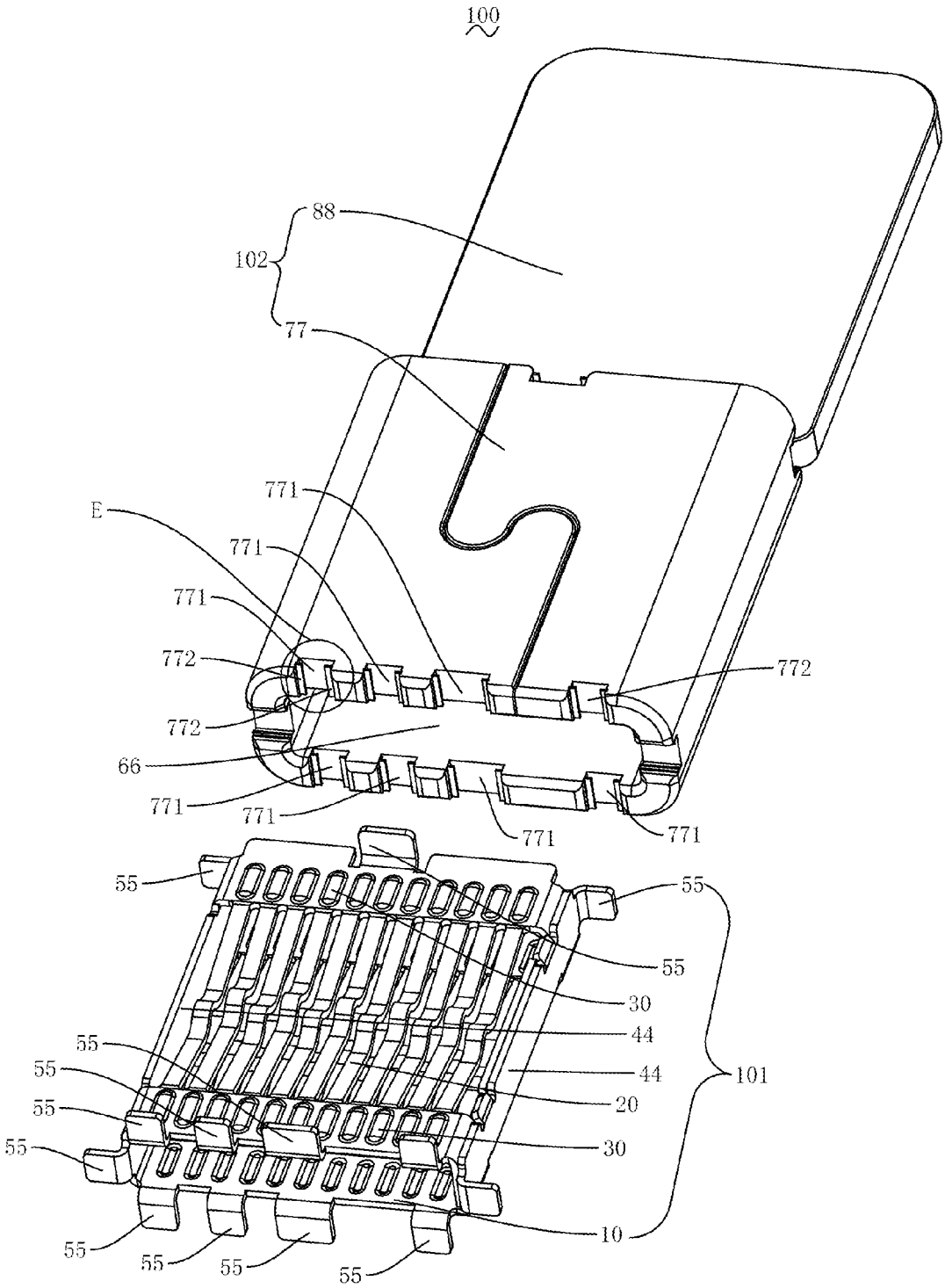
FIG. 6 is an exploded perspective view of the connection assembly in FIG. 5.

The present invention is described below in detail with reference to the accompanying drawings.

Referring to FIG. 1 to FIG. 4, FIG. 1 to FIG. 4 illustrate a connection member 101 provided by the present invention. The connection member 101 includes a support body 10, current conduction bars 20, and protruding contact portions 30.

The support body 10 is used to support and dispose the current conduction bars 20 and the protruding contact portions 30. According to connection and mounting requirements, the support body 10 may be a support, a platform, or the like. In this embodiment, the support body 10 has a chamber 11 that runs through the support body 10 along a length direction of the current conduction bars 20. The chamber 11 can be used to accommodate another device, or be connected to another connection terminal. In this embodiment, the support body 10 includes two support end portions 15. Each of the support end portions 15 has an upper end portion 12 and a lower end portion 13. The support end portions 15 are connected to two ends of the current conduction bars 20 respectively, so as to further improve the stable support of the current conduction bars 20. It should be noted that, when the chamber 11 is not provided, i.e. when the support body 10 is solid, the support body 10 has an upper surface and a lower surface. Further, both the upper surface and the lower surface of the support body 10 can be provided with the protruding contact portions 30.

The current conduction bars 20 are disposed at the end portions of the support body 10. The current conduction bars 20 are used to transmit a current. The number and size specifications of the current conduction bars 20 are selected according to the requirement of current transmission. In this embodiment, in order to fully utilize space and improve electrical conductivity, two groups of current conduction bars 20 are provided. Each group of current conduction bars 20 includes at least one current conduction bar 20. In this embodiment, each group of current conduction bars 20 includes eleven current conduction bars 20. Two ends of the current conduction bar 20 are connected to the support end portions 15 of the support body 10 respectively. The current conduction bar 20 includes terminal contact portions 21 and an arching portion 22. The terminal contact portions 21 arch from the current conduction bar 20 in a direction opposite to the protruding direction of the protruding contact portion 30. That is, the arching direction of the terminal contact portion 21 is opposite to the protruding direction of the protruding contact portion 30. The terminal contact portions 21 are used to come into electrical contact with mating terminals. For example, the connection member 101 may be a female terminal. The terminal contact portions 21 are used to form an electrical connection to mating male terminals. In this embodiment, two terminal contact portions 21 are provided, and these two terminal contact portions are disposed at two ends of the arching portion 22 respectively, so as to improve electrical connection stability.

In this embodiment, the current conduction bar 20 comprises a first connection portion (not shown) and a second connection portion (not shown). The first connection portion is connected between one support end portion 15 of the support body 10 and one terminal contact portion 21. The second connection portion is connected between the other support end portion 15 and the other terminal contact portion 21. Lengths of the first connection portion and the second connection portion may be selected according to requirements as long as the first connection portion and the second connection portion can be connected to the support portions 15 respectively. In this embodiment, the length of the first connection portion is greater than that of the second connection portion. Any two adjacent current conduction bars 20 are connected to the two support bodies 10 in opposite directions. That is, the first connection portion of one of the two adjacent current conduction bars 20 is connected to one support portion 15, the second connection portion of the one of the two adjacent current conduction bars 20 is connected to the other support portion 15, the first connection portion of the other one of the two adjacent current conduction bars 20 is connected to the other support portion 15, and the second connection portion of the other one of the two adjacent current conduction bars 20 is connected to the one support portion 15. Any two adjacent current conduction bars 20 are connected to the support body 10 in opposite directions, so that the arching portions 22 are disposed staggerly, thereby saving space and avoiding interference.

The arching portion 22 bends and arches along a direction perpendicular to a surface of the support body 10, that is, arches along the protruding direction of the protruding contact portion 30. When the current conduction bars 20 come into contact with the mating male terminals, the arching portions 22 serve to support to some extent, to prevent the current conduction bars 20 from deforming excessively. In this case, the arching portions 22 also increase a contact area between the current conduction bars 20 and the housing 102, thereby improving electrical connection performance. In this embodiment, the current conduction bars 20 are divided into two groups, and the two groups of current conduction bars 20 are disposed back to back. That is, arching directions of the arching portions 22 of one group of current conduction bars 20 are opposite to arching directions of the arching portions 22 of the other group of current conduction bars 20. That is, one group of the arching portions 22 bend and arch or protrude upward along a direction perpendicular to the upper end portion 12 of the support end portion 15, and the other group of the arching portions 22 bend and arch downward along a direction perpendicular to the lower end portion 13 of the support end portion 15.

The current conduction bar 20 may be made as a single piece by using metal. In this embodiment, in order to facilitate manufacturing and improve stability, the current conduction bar 20 is formed as a single piece through stamping. All of the current conduction bars 20 are spaced from each other, so as to form corresponding current channels and increase a heat dissipation area, thereby improving heat dissipation performance.

The protruding contact portions 30 are disposed on the surface of the support body 10 in a protruding manner. A protruding height of the protruding contact portion 30 relative to the surface of the support body 10 is greater than a maximum height of the current conduction bar 20. In this embodiment, the protruding contact portions 30 are in a one-to-one correspondence with the two ends of the current conduction bars 20. Correspondingly, the protruding contact portions 30 may be disposed on the upper end portion 12 and/or the lower end portion 13 of the support end portion 15. In this embodiment, the upper end portion 12 has an upper surface (not shown), and the lower end portion 13 has a lower surface (not shown). Both the upper surface and the lower surface are provided with the protruding contact portions 30. Specifically, the protruding contact portions 30 are disposed on the upper surface of the upper end portion 12 and the lower surface of the lower end portion 13. The protruding height of the protruding contact portion 30 relative to the upper end portion 12 or the lower end portion 13 is greater than the maximum height of the current conduction bar 20, that is, greater than a height by which the arching portion 22 of the current conduction bar 20 bends and arches along the direction perpendicular to the upper end portion 12 or the lower end portion 13, so that when not subjected to external force, the arching portion 22 is spaced from the housing 102, thereby improving heat dissipation performance and avoiding local overheating of the housing 102.

In this embodiment, the protruding contact portion 30 abuts the current conduction bar 20 along the length direction of the current conduction bar 20, so that the current channel between the protruding contact portion 30 and the current conduction bar 20 is shortest, thereby reducing a current loss as much as possible.

Figure 11:
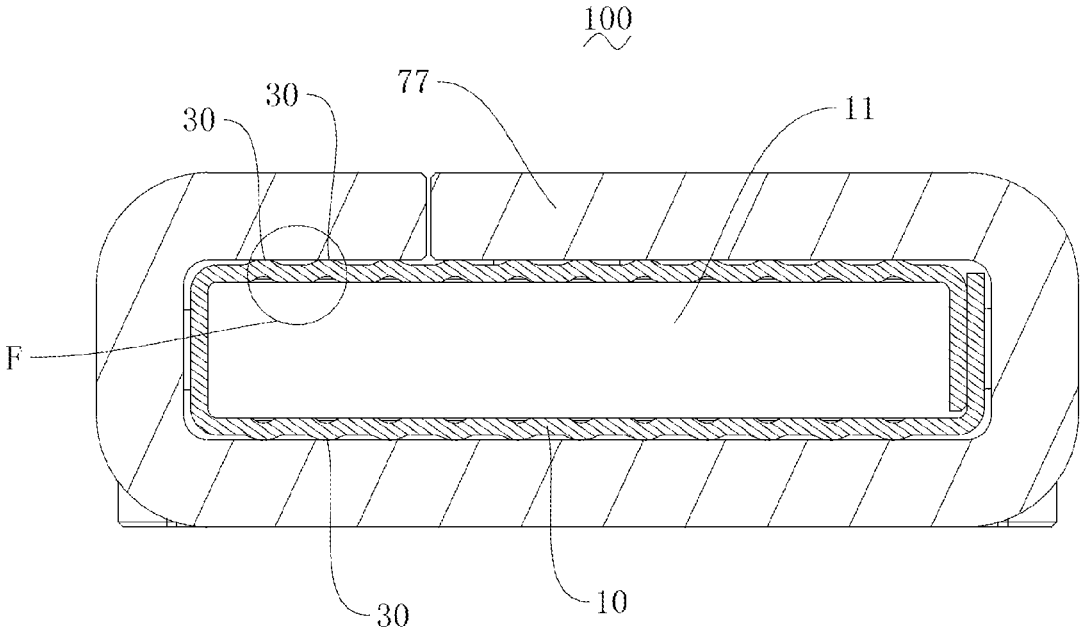
FIG. 11 is a sectional view of the connection assembly taken along line B-B in FIG. 5.
Figure 12:
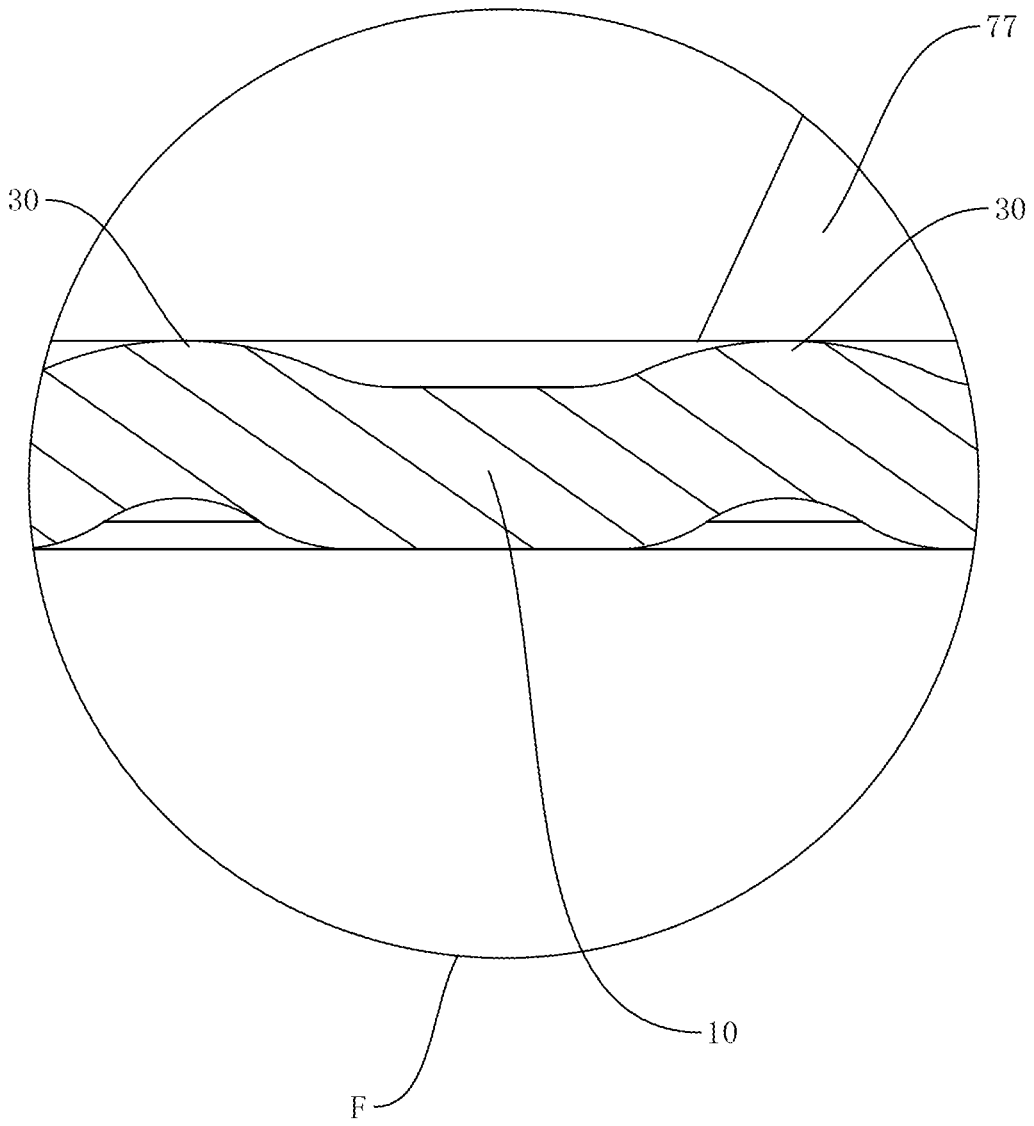
FIG. 12 is a schematic enlarged view at position F of the connection assembly in FIG. 11.

As shown in FIG. 11 and FIG. 12, the shape and the height of the protruding contact portion 30 only need to enable the protruding contact portion 30 to be urged against the housing 102. In this embodiment, in order to improve electrical connection performance between the protruding contact portions 30 and the housing 102 and avoid a burning problem caused by relative high temperature of a certain local contact area between the housing 102 and the current conduction bars 20 because of uneven contact between the current conduction bars 20 and the housing 102 due to tolerances of multiple protruding contact portions 30 and multiple current conduction bars 20, the protruding contact portions 30 extend along the length direction of the current conduction bars 20.

In order to further facilitate to mount the connection member 101 in the housing 102 and to remove the connection member 101 from the housing 102, and in order to make the connection member 101 have larger contact area with the housing 102 to achieve desirable connection performance, the protruding contact portion 30 has a partially ellipsoidal surface. A major axis of the ellipsoid and the length direction of the current conduction bar 20 maybe collinear. That is, the foregoing protruding contact portion 30 abuts the current conduction bar 20 along the length direction of the current conduction bar 20. To facilitate manufacturing and improve stability of the protruding contact portion 30 disposed on the support body 10, the protruding contact portion 30 is of a stamped structure.

In this embodiment, in order to improve stable connection performance between two support bodies 10, and to improve integrity of the connection member 101, the connection member 101 further includes reinforcing portions 44. The reinforcing portions 44 are connected to the two support bodies 10 respectively. In this embodiment, two reinforcing portions 44 are provided. These two reinforcing portions 44 are disposed on two sides of the connection member 101 along the length direction thereof. The shape and the structure of the reinforcing portion 44 only need to enable the reinforcing portion 44 to be connected between the two support bodies 10 to bear a certain external force to improve connection performance, and to prevent the current conduction bar 20 from deforming or even breaking when the connection member 101 is subjected to pushing force or pulling force along the length direction of the current conduction bar 20. The reinforcing portion 44 may be in the shape of a regular rod or in an irregular shape. In this embodiment, the reinforcing portion 44 is plate-shaped. In order to facilitate manufacturing and fully utilizing space to leave room for other components, each of the reinforcing portions 44 is connected to the upper end portion 12 and the lower end portion 13 of each support body 15.

In order to be more stably disposed in the housing 102, the connection member 101 further includes mounting claws 55. The mounting claws 55 are disposed on the support body 10 in a protruding manner. The mounting claw 55 is configured to be capable of bending to engage with the housing 102 as a retainer. The mounting claw 55 may be a metal capable of bending and deforming. Certainly, the mounting claws 55 may also be fixed on the support body 10 through welding, snapping, screwing, or the like and engage with the housing 102 as a retainer after the connection member 101 is mounted in the housing 102. Sizes of the multiple mounting claws 55 may be different according to requirements.

In order to reduce manufacturing costs, improve stability, and enhance integrity, in this embodiment, the connection member 101 is made as a single piece through stamping by using a single piece of copper. Certainly, according to corresponding connection performance, the connection member 101 may also be made of aluminum or iron.

Referring to FIG. 5 to FIG. 12, FIG. 5 to FIG. 12 are schematic structural views of a connection assembly 100 according to the present invention. The connection assembly 100 includes the foregoing connection member 101 and a housing 102. The housing 102 has an accommodation chamber 66. The shape, structure, and size of the accommodation chamber 66 only need to enable the housing 102 to accommodate the connection member 101 and come into contact with the protruding contact portions 30 of the connection member 101 to achieve electrical connection. In this embodiment, the accommodation chamber 66 is a substantially rectangular accommodation chamber. Certainly, to facilitate removal of the connection member 101, a side wall of the accommodation chamber 66 is provided with a curved chamber.

Figure 10:
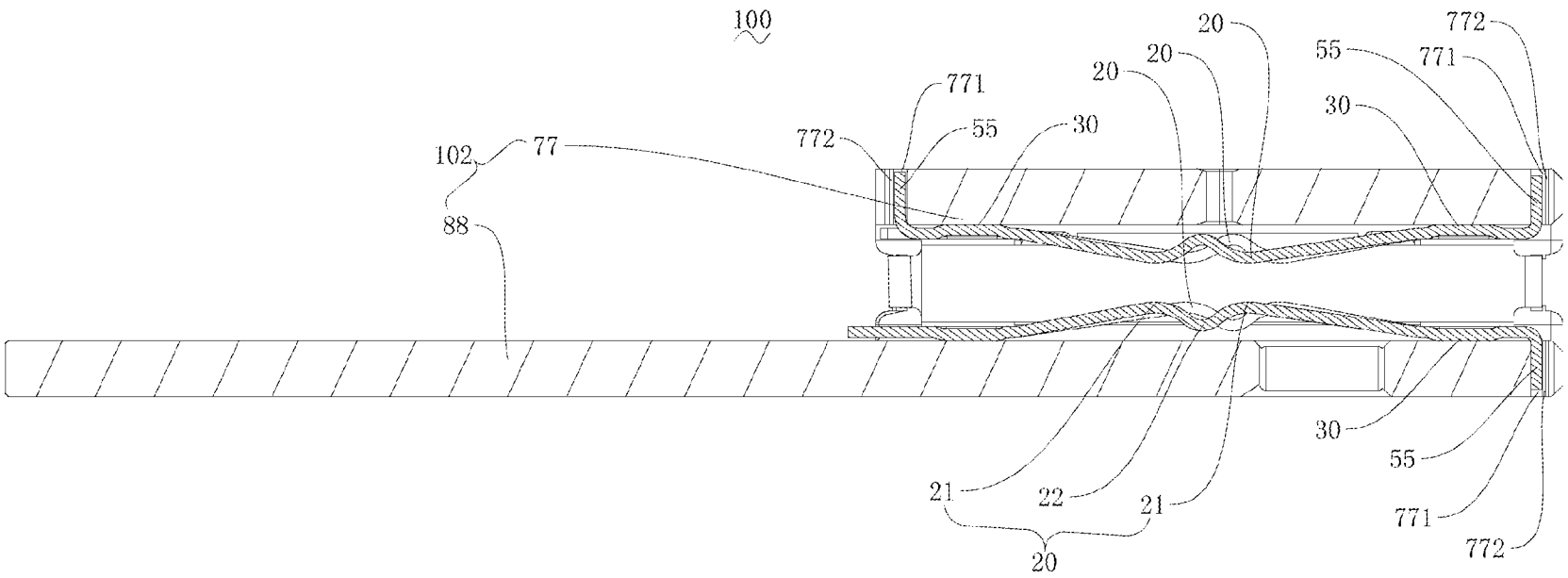
FIG. 10 is a sectional view of the connection assembly taken along line A-A in FIG. 5.

Referring to FIG. 10, the specific shape and structure of the housing 102 only need to meet a corresponding mounting requirement. In this embodiment, the housing 102 includes a mounting portion 77 and a support plate 88. The accommodation chamber 66 is opened on the mounting portion 77. The support plate 88 is disposed on the mounting portion 77, and extends along a length direction of the mounting portion 77.

The mounting claws 55 of the connection member 101 engages with the housing 102 as a retainer, so as to further stably dispose the connection member 101 on the housing 102. In this embodiment, multiple mounting claws 55 are provided. The mounting claws 55 are disposed at two ends of the support body 10, and engage with two end portions of the mounting portion 77 as a retainer, so as to mount the connection member 101 more stably.

In order to form a more stable engagement with the mounting claws 55, the two end portions of the mounting portion 77 are provided with limiting slots 771. The mounting claws 55 are accommodated in the limiting slots 771.

Figure 7:
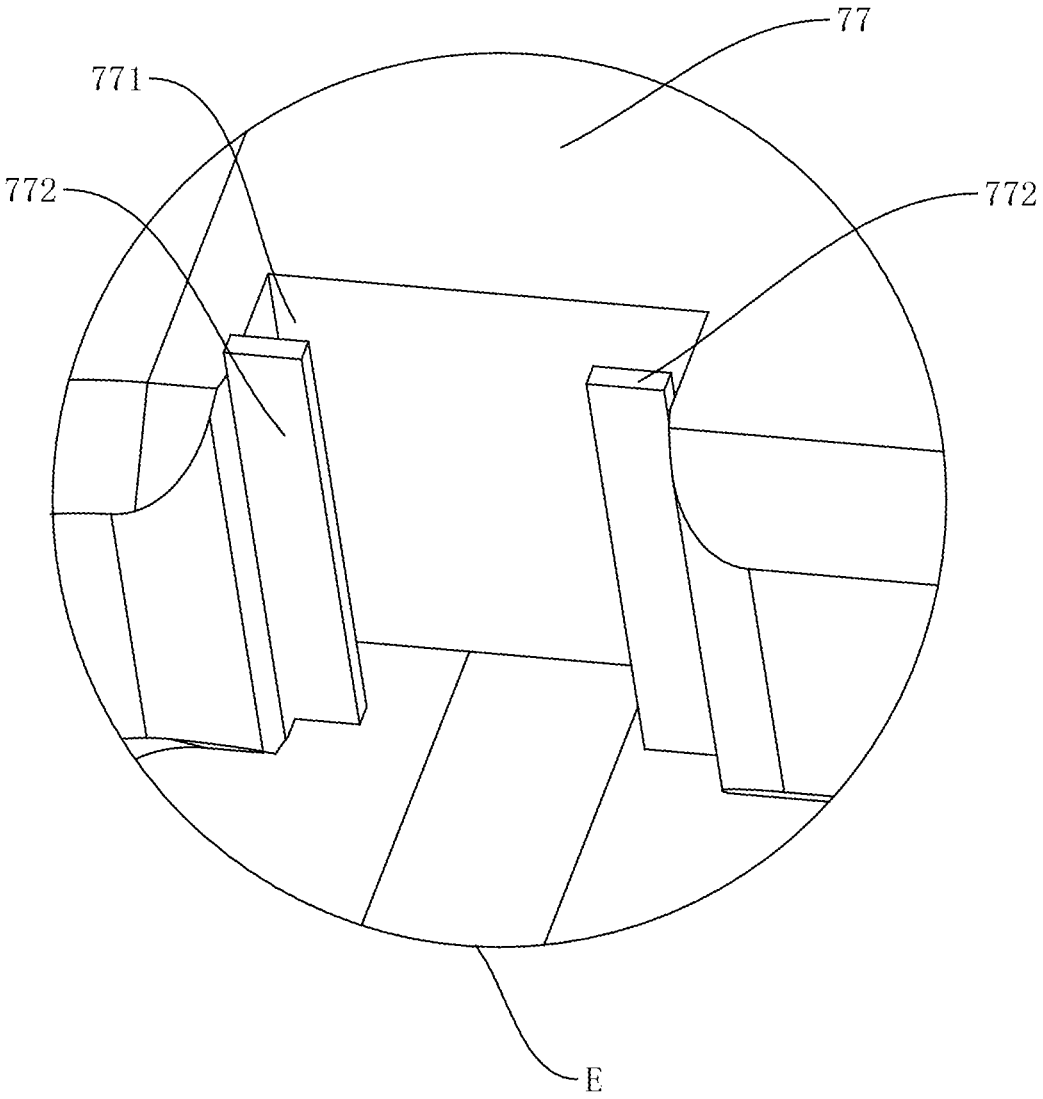
FIG. 7 is a schematic enlarged view at position E of the connection assembly in FIG. 6.
Figure 8:
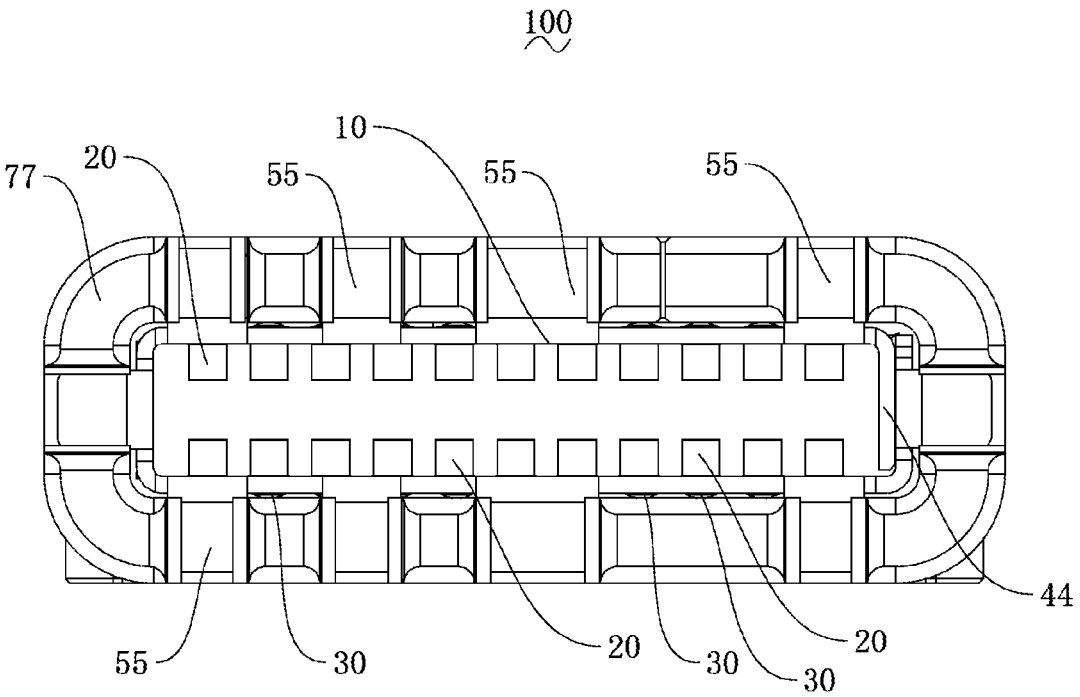
FIG. 8 is a front view of the connection assembly in FIG. 5.
Figure 9:
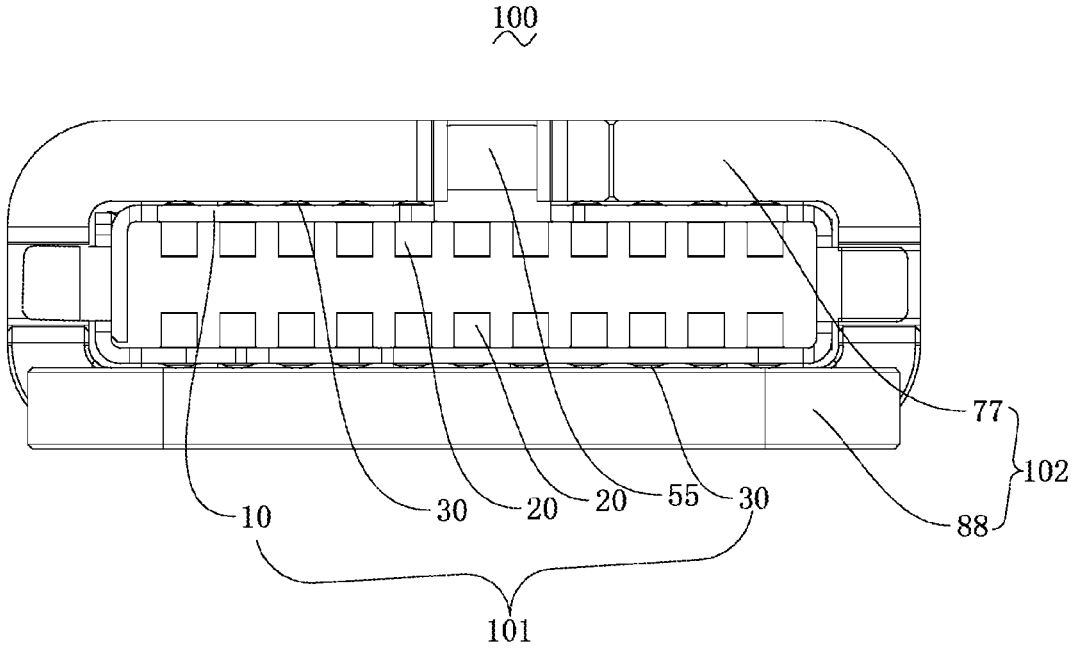
FIG. 9 is a rear view of the connection assembly in FIG. 5.

In order to further prevent the mounting claws 55 from loosening, the opening of the limiting slot 771 is provided with limiting portions 772 that protrude laterally, that is, protrude in left and right directions as shown in FIG. 7. The limiting portions 772 are used to hold the mounting claws 55 in the limiting slots 771. That is, the limiting portions 772 securely engage with the mounting portion 77 along the length direction of the mounting portion 77. The protruding limiting portions 772 extend to at least partially overlap with the mounting claws 55 along the length direction of the connection member 101, so as to further prevent the mounting claws 55 from moving from the openings of the limiting slots 771 to the extent that escape limitation imposed by the limiting slots 771. In this embodiment, the limiting portions 772 are shaped as flat plate.

In order to reduce manufacturing costs, improve stability, and enhance integrity, in this embodiment, the housing 102 is made as a single piece through stamping by using a single piece of copper.

It should be noted that, "above" and "below", "front" and "rear", and "left" and "right" appearing in the present invention are relative orientations, and are only intended to more clearly describe, with reference to the accompanying drawings, the embodiments provided by the present invention, but are not intended to limit the protect scope of the present invention. In addition, it should be further noted that, in this embodiment, the protruding direction of the protruding contact portions 30 disposed on the upper end portion 12 (or the upper surface) of the support body 10 and the protruding direction of the protruding contact portions 30 disposed on the lower end portion 13 (or the lower surface) of the support body 10 are opposite, that is, are back to back.

Compared with the prior art, the connection member 101 of the present invention are connected to the housing 102 via the protruding contact portions 30, so that not only a contact area is increased, but also shaking of the connection member 101 in the housing 102 is avoided, thereby not only improving a large-current passing capacity, but also improving electrical connection stability. Compared with that current conduction bars 20 not only need to transmit a current but also need to come into contact with a housing 102 to achieve electrical connection, in the present invention, the protruding contact portions 30 are only used to come into contact with the housing 102, so that the structures of the protruding contact portions 30 and current conduction bars 20 can be more easily realized, and performance is better.

Preferably, the protruding contact portions 30 extend, so that more stable connection performance can be achieved. The protruding contact portions 30 abut the current conduction bars 20 in a one-to-one correspondence, so that the transmission distance can be reduced, and the transmission loss can be reduced. The protruding contact portions 30 have a partially ellipsoidal surface, so that when the protruding contact portions 30 are relatively large in number, stable contact can be maintained even in a relatively large tolerance range. The terminal contact portions 21 of the current conduction bar 20 arch toward the inside of the chamber 11 of the support body 10, thereby facilitating to form a plug-in engagement with a mating male terminal and to form a desirable contact. Arching portions 22 of the current conduction bars 20 can come into contact with the housing 102 when the current conduction bars 20 forms plug-in engagement with the mating male terminal, thereby increasing an electrical contact area and improving electricity conduction performance.

The foregoing is only preferred embodiments of the present invention, but is not intended to limit the protection scope of the present invention. Any modification, equivalent replacement, or improvement made without departing from the spirit of the present invention falls within the scope of the claims of the present invention.

What is claimed is:

1. A connection member, comprising:

a support body, having a surface and a support end portion;

a current conduction bar, connected to the support end portion of the support body and having an electrical contact surface on a first side thereof to transmit a current; and a protruding contact portion, disposed on the surface of the support body and protruding in a direction opposite to that of the electrical contact surface, wherein the protruding contact portion is capable of urging against a housing with which the connection member engages.

2. The connection member according to claim 1, wherein the protruding contact portion extends along length direction of the current conduction bar.

3. The connection member according to claim 1, wherein the protruding contact portion abuts the current conduction bar along the length direction of the current conduction bar.

4. The connection member according to claim 1, wherein the protruding contact portion has partially ellipsoidal surface.

5. The connection member according to claim 1, wherein the protruding contact portion is of a stamped structure.

6. The connection member according to claim 1, wherein the support body has two support end portions, the two support end portions are spaced from each other along a length direction of the current conduction bar and disposed at a front end and a rear end of the support body;

the current conduction bar has two ends, which are connected to the two support end portions respectively; and the protruding contact portion is disposed on a surface of at least one of the support end portions.

7. The connection member according to claim 6, wherein each of the support end portions has an upper end portion and a lower end portion;

the support body is provided with a chamber that runs through the support body along the length direction of the current conduction bars;

the chamber is disposed between the upper end portion and the lower end portion; and the protruding contact portion is disposed on an upper surface of the upper end portion and/or a lower surface of the lower end portion.

8. The connection member according to claim 7, wherein the connection member further comprises a reinforcing portion;

the reinforcing portion has two ends connected to the two support end portions respectively; and each of the ends of the reinforcing portion is connected to the upper end portion and the lower end portion of the corresponding support end portion.

9. The connection member according to claim 1, wherein the surface of the support body comprises an upper surface and a lower surface, and the upper surface and the lower surface are both provided with the protruding contact portion.

10. The connection member according to claim 1, comprising two groups of current conduction bars disposed back to back, wherein each group of current conduction bars comprises at least one current conduction bar.

11. The connection member according to claim 10, wherein the current conduction bars are spaced from each other.

12. The connection member according to claim 1, wherein the current conduction bar arches in a direction opposite to the protruding direction of the protruding contact portion, to form a terminal contact portion; and the terminal contact portion is used to come into electrical contact with a mating terminal.

13. The connection member according to claim 1, wherein the current conduction bar comprises an arching portion, which arches along a protruding direction of the protruding contact portion.

14. The connection member according to claim 1, wherein the connection member is an integrally stamped member.

15. The connection member according to claim 1, wherein the connection member further comprises mounting claws, which are disposed at front and rear ends of the support body in a protruding manner and configured to be capable of bending to engage with the housing as a retainer, when the housing engages with the connection member.

16. A connection assembly, comprising:

a housing, the housing being formed with an accommodation chamber; and the connection member according to claim 1, when the connection member is inserted in the accommodation chamber, the protruding contact portion is urged against the housing.

17. The connection assembly according to claim 16, wherein the connection member further comprises mounting claws, the mounting claws are disposed on the support body in a protruding manner, and the mounting claws engage with the housing as a retainer.

18. The connection assembly according to claim 17, wherein the housing comprises a mounting portion and a support plate; the support plate is disposed on the mounting portion and extends along a length direction of the mounting portion; and the accommodation chamber is opened on the mounting portion.

19. The connection assembly according to claim 18, wherein a front end portion and a rear end portion of the mounting portion are provided with limiting slots, and the mounting claws are accommodated in the limiting slots.

20. The connection assembly according to claim 19, wherein an opening of the limiting slot is provided with limiting portions that protrude laterally, and the limiting portions are used to limit the mounting claw within the limiting slot.

* * * * *